United States Patent [19]

Kuhnle et al.

[11] Patent Number: 4,986,185

[45] Date of Patent: Jan. 22, 1991

[54] GRENADE DEVICE

[75] Inventors: William G. Kuhnle, Hopatcong; James F. Murnane, II, Andover, both of N.J.

[73] Assignee: The United States of America as represented by the Secretary of the Navy, Washington, D.C.

[21] Appl. No.: 349,557

[22] Filed: May 8, 1989

[51] Int. Cl.[5] ..... F42B 10/48; F42B 12/58

[52] U.S. Cl. ..... 102/388; 416/DIG. 3; 446/36; 446/217; 446/218

[58] Field of Search ..... 446/36, 217, 218; 416/DIG. 2, DIG. 3, 223 R; 102/386, 388, 385, 393, 489, 482

[56] References Cited

U.S. PATENT DOCUMENTS

| | | | |
|---|---|---|---|
| 1,559,696 | 11/1925 | Heberling | 446/217 |
| 1,639,943 | 8/1927 | Heberling | 446/217 |
| 1,985,467 | 12/1934 | Smaldone et al. | 446/217 |
| 2,044,819 | 6/1936 | Taylor | 102/388 |
| 2,302,054 | 11/1942 | Putt | 416/DIG. 3 |
| 3,273,834 | 9/1966 | Bower | 102/388 |
| 3,964,391 | 6/1976 | Zacharin | 102/388 |
| 4,161,371 | 7/1979 | Sheppa | 102/208 |
| 4,445,817 | 5/1984 | Wethern | 416/DIG. 3 |
| 4,665,332 | 5/1987 | Meir | 102/208 |
| 4,756,253 | 7/1988 | Herring et al. | 102/393 |

FOREIGN PATENT DOCUMENTS

| | | | |
|---|---|---|---|
| 711955 | 10/1941 | Fed. Rep. of Germany | 446/217 |
| 97306 | 1/1961 | Norway | 446/217 |

*Primary Examiner*—David H. Brown

*Attorney, Agent, or Firm*—Robert P. Gibson; Edward Goldberg; Edward F. Costigan

[57] ABSTRACT

A grenade device for use with and for ejection from an artillery shell is provided. The device includes a stabilizing propeller and a grenade body. The propeller has two opposite blades disposed on opposite sides of a rotation axis. Each blade has an upper tilted portion and a lower substantially flat portion and a connecting return bend tip portion. Each such portion has a leading edge and a trailing edge. Each upper tilted portion has a transverse angle of attack. The upper tilted portions bave a common longitudinal upper projected axis. The lower flat portions also have a common longitudinal lower projected axis. The common longitudinal upper projected axis and the common longitudinal lower projected axis form a projected displacement angle therebetween. The propeller is made from a flexible metal or fabric ribbon. The blades are folded in a nested arrangement before descent. During descent, the blades unfold to their overall aerodynamic shape. The propeller has a windmill type of rotation during descent. The grenade body may have an alternator as part of an electronic fuze, which is connected to a shaft, that is connected to the propeller coaxially therewith along the rotation axis for energizing the alternator.

4 Claims, 1 Drawing Sheet

GRENADE DEVICE

GOVERNMENTAL INTEREST

The invention described herein may be manufactured, used and licensed by or for the Government for Governmental purposes without payment to us of any royalties.

The invention relates to a grenade device, and in particular the invention relates to a grenade device having a stabilizing propeller.

BACKGROUND OF THE INVENTION

The prior art grenade device, which is ejected from an artillery shell, has a nylon stabilizing ribbon loop and a grenade body to which the loop is attached.

One problem with the prior art grenade device is that the stabilizing loop does not adequately stabilize and reduce the spinning of the grenade device during a descent of the grenade device.

SUMMARY OF THE INVENTION

According to the present invention, a grenade device is provided. This grenade device includes a dual blade propeller having a shaft, and a grenade body to which the shaft is rotatably connected.

By using the propeller having a shaft rotatably connected to the grenade body, aerodynamic forces on the propeller create a torque that opposes the spinning of the grenade body about its axis, and the forces slow the descent of the grenade device, and the forces stabilize the orientation of the grenade device, during a descent of the grenade device. Also, rotation of the propeller relative to the grenade body can be used to drive an alternator-type fuze.

The foregoing and other objects, features and advantages will be apparent from the following description of the preferred embodiment of the invention as illustrated in the accompanying drawings.

DESCRIPTION OF THE PREFERRED EMBODIMENT

Figure 1:
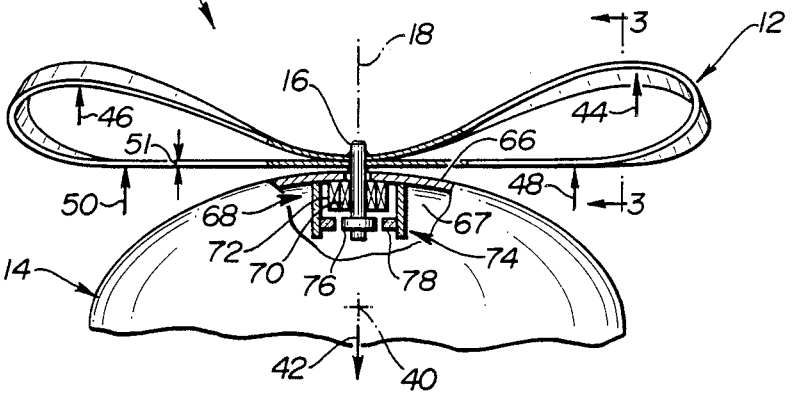
FIG. 1 is an elevation view of a grenade device according to the invention.

As shown in FIG. 1, device 10 is a stabilized grenade device or assembly. Device 10 has a propeller, or propeller stabilizer subassembly 12, and has a grenade, or grenade body subassembly 14.

Figure 2:
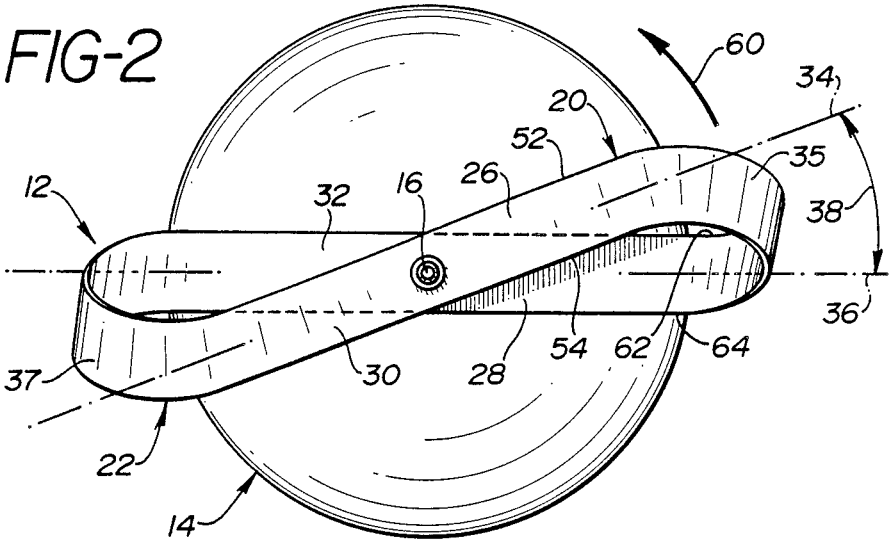
FIG. 2 is a top view of FIG. 1.

As shown in FIGS. 1 and 2, propeller 12 is fixedly connected to a shaft 16, which has a shaft axis 18. Propeller 12, which is a dual blade propeller, has a right blade 20 and a left blade 22.

Right blade 20 has an upper tilted portion 26 and has a lower flat portion 28. Left blade 22 also has an upper tilted portion 30 and has a lower flat portion 32.

Upper tilted portions 26, 30 have a common axis of symmetry 34. Upper tilted portions 26, 30 also have respective downwardly curved tip portions 35, 37, which respectively connect to lower flat portions 28, 32.

Lower flat portions 28, 32 have a common axis of symmetry 36. Axes 34 and 36 are angularly displaced by a projected angle 38 about shaft axis 18.

As shown in FIGS. 1 and 2, propeller 12 and grenade 14 have a common center of gravity 40; and have a downward gravity force which acts through center of gravity 40 during a descent or free fall of device 10.

Upper tilted portions 26, 30 have respective upward vector forces 44, 46 which act normal to the surface of the upper tilted portions 26, 30 during such descent or fall. Lower flat portions 28, 32 also have respective upward vector forces 48, 50, which act thereon during such descent. Lower flat portions 28, 32 are substantially flat from the shaft axis 18 outwardly to an area thereof, where the flat portion 28 or 32 connects to its respective tip portion 35 or 37. In this embodiment, the lower flat portions 28, 32 have substantially no tilt or no twist. Also, right blade 20, which is identical to left blade 22, has a wall thickness 51, which is uniform in thickness.

Figure 3:
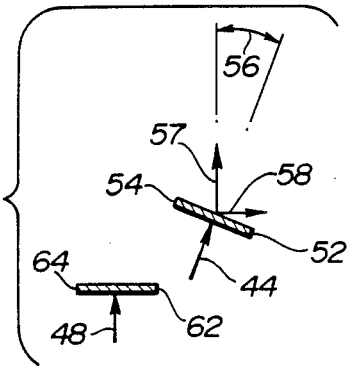
FIG. 3 is a section view as taken along the line 3—3 of FIG. 1.

As shown in FIG. 3, upper tilted portion 26, which is identical to upper tilted portion 30, has a leading edge 52 and a trailing edge 54. Portion 26 also has an angle of tilt or tilt angle 56. Upward force 44 has a vertical lift component 57. Force 44 also has a tangential or torque producing force component 58, as shown in FIG. 3. This tangential component 58 causes rotation of propeller 12 relative to grenade 14 in a direction 60, as shown in FIG. 2.

Lower flat portion 28, which is identical to lower flat portion 32, also has a leading edge 62 and a trailing edge 64. Portion 28 has substantially no tilt angle in this embodiment.

Grenade 14 has an exterior or casing wall 66, which encloses a cavity 67. Grenade 14 also has a bearing 68. Bearing 68 has an inner race 70 that is fixedly connected to shaft 16; and has an outer race 72 that is fixedly connected to wall 66. Thus, shaft 16 can rotate relative to grenade 14.

Grenade 14 may also have a fuze that includes an alternator 74. Alternator 74 has a rotor 76, which is fixedly connected to shaft 16; and has a stator 78, which is fixedly connected to wall 66. Thus, rotation of propeller 12 and shaft 16 produces an induced electrical current.

Cavity 67, in which alternator 74 is disposed, also contains an explosive material (not shown).

In this embodiment, propeller 12 is made using a flexible metal or fabric ribbon. Propeller 12 cam be folded in a closely packed, nesting arrangement. Propeller 12 assumes the aerodynamic shape, as shown in FIGS. 1, 2 and 3, during its separate descent or flight. In such shape, upper tilted portions 26, 30 respectively have a tilt angle 56 and a torque producing component 58.

Propeller 12 is fixedly connected to shaft 16 by a tack weld or the like. Projected angle 38, as shown in FIG. 1, is about 20 degrees. Tilt angle 56, as shown in FIG. 3, is about 25 degrees.

Alternator 74 connects to an electronic fuze (not shown).

The locations of normal forces 44, 46, 48, 50 each depends on the projected, downwardly facing areas of their respective portions 26, 30, 28, 32. The sum of upward forces 44, 46, 48, 50 is less than the value of downward force 42. Propeller 12 has a windmill type of rotation during the descent of device 10.

Propeller 12 is made from a continuous loop of material of about 0.50 inch width by about 11.0 inch length, thereby forming two blades of about 2.50 inch length each.

The longitudinal projected profile of leading edges 52, 62 is narrower and longer, than the longitudinal profile of trailing edges 54, 64, as shown in FIG. 1.

In operation, propeller 12 acts as a stabilizer to stabilize and to reduce spinning of grenade 14, during a descent of device 10. Propeller 12 permits device 10 to impact in a substantially vertical direction at an optimum spin rate. Device 10 is a type of grenade device which is ejected from an artillery shell. Propeller 12 stabilizes and/or despins grenade device 10 in its descent. Propeller 12 transmits a torque in direction 60 to drive an alternator 74, which is a conventional design. Device 10 is able to land in an approximately vertical direction and to land approximately perpendicular to a target. The spinning of device 10 is also minimized at its landing.

In the manufacture of propeller 12, a structural ribbon is first shaped to form two substantially identical bow-shaped blades 20, 22 with each blade 20, 22 having an upper portion 26, 30 with a leading edge 52 and a trailing edge 54 and having a lower portion 28, 32 with a leading edge 62 and a trailing edge 64. The upper portions 26, 30 then are aligned along a common upper axis 34; and the lower portions 28, 32 are aligned along a lower axis 36. Upper portions 26, 30 are then angularly displaced relative to lower portions 28, 32 so that a projected angle 38 is formed between upper axis 34 and lower axis 36 and so that upper portions 26, 30 have a tilt angle 56 and so that curved return tip portions 35, 37 are shaped. Upper portions 26, 30 are then fixedly connected to lower portions 28, 32 near a rotation axis 18 located about midway between the tip portions 35, 37. Then, a shaft 16 is fixedly connected to blades 20, 22 coaxially along rotation axis 18.

In summary, a grenade device 10 with a ribbon type stabilizer or propeller 12 is provided. The stabilizer or propeller 12 has a shape, in general, like a conventional propeller. Propeller 12 is made of a flexible ribbon; and propeller 12 can be folded in order to allow a plurality of devices 10 to be nested. While in flight or descent, propeller 12 unfolds from its nested, folded shape to a shape, as shown in FIGS. 1, 2 and 3. The upper portions 26, 30 have a tilt angle or blade angle of attack 56. Propeller 12 is a passive-type propeller in that the air flow moves in an upward direction parallel to the rotation axis 18 and causes the propeller 12 to rotate relative to grenade body 14. Upper portions 26, 30 and lower portions 28, 32 have respective air pressure normal forces 44, 46, and 48, 50. Normal forces 44, 46 have respective lift components 57 and tangential or torque producing force components 58. Lift components 57 slow down the descent of device 10. Tangential components 58 provide torque to drive alternator 74.

The advantgages of device 10 are indicated hereafter.

(a) Device 10 has a stabilizer or propeller 12 which stabilizes device.

(b) Propeller 12 reduces the spinning of device 10 during a descent or fall.

(c) Propeller 12 helps to maintain the orientation in space of device 10 during a descent or fall.

(d) Propeller 12 causes device 10 to move downwardly in a substantially vertical direction and to land about perpendicular to a target for better accuracy and effectiveness.

(e) Propeller 12 causes device 10 to impact vertically while maintaining an optimum spin rate, for improving system performance.

(f) Propeller 12 is foldable for reducing its overall volume and for ease of packing in a nested arrangement before ejection of device 10.

(g) Propeller 12 automatically unfolds and assumes its shape upon descent.

(h) Propeller 12 transmits torque to alternator 74 during descent of device 10 for charging a capacitor of a conventional fuze circuit.

While the invention has been described in its preferred embodiment, it is to be understood that the words which have been used are words of description rather than limitation and that changes may be made within the purview of the appended claims without departing from the true scope and spirit of the invention in its broader aspects.

The foregoing disclosure and drawings are merely illustrative of the principles of this invention and are not to be interpreted in a limiting sense. We wish to be understood that we do not desire to be limited to the exact details of construction shown and described because obvious modifications will occur to a person skilled in the art.

The embodiments of an invention in which an exclusive property or right is claimed are defined as follows:

1. A grenade device for ejection from an artillery projectile comprising:

a flexible stabilizing fabric propeller means capable of assuming variable shapes about a rotational axis; and a grenade body housing a charge connected to said propeller;

said propeller having two opposite blades which assume said variable shapes according to air speed and spin rate;

each blade having an upper tilted portion with a leading edge and a trailing edge and having a lower approximately flat portion with a leading edge and a trailing edge and having a bend return tip portion connecting to the upper tilted portion and connecting to the lower flat portion;

the upper tilted portion having a transverse angle of attack and having a longitudinal upper projected axis passing through the rotation axis; and the lower flat portion having a longitudinal lower projected axis passing through the rotation axis with the longitudinal upper projected axis and the longitudinal lower projected axis forming a projected displacement angle therebetween.

2. The device of Claim 1, including:

A shaft disposed coaxially along the rotation axis and being fixedly connected to the stabilizing propeller at one end of the shaft.

3. The device of Claim 2, wherein:

the grenade body is rotatably connected to the shaft at an opposite end of the shaft.

4. The device of Claim 3, wherein:

the grenade body has an exterior wall forming a cavity; and wherein, the grenade body has an alternator with a rotor coaxially mounted on the shaft and with a stator mounted on the exterior wall; and wherein, said alternator is driven by said flexible, variable shaped propeller, the grenade body has a bearing with an inner race coaxially mounted on the shaft and with an outer race mounted on the exterior wall.

* * * * *